United States Patent [19]

Thijssen et al.

[11] Patent Number: 4,643,803

[45] Date of Patent: Feb. 17, 1987

[54] METHOD OF MAKING COKE IN A COKE OVEN BATTERY

[75] Inventors: Nicolaas J. W. Thijssen, Santpoort Noord; Timen Vander, Ursem, both of Netherlands

[73] Assignee: Hoogovens Groep B.V., IJmuiden, Netherlands

[21] Appl. No.: 674,752

[22] Filed: Nov. 26, 1984

[30] Foreign Application Priority Data

Nov. 28, 1983 [NL] Netherlands ..... 8304066

[51] Int. Cl.[4] ..... C10B 21/00; C10B 21/10

[52] U.S. Cl. ..... 201/1; 202/151

[58] Field of Search ..... 201/1, 41; 202/151, 202/262, 270; 414/198; 374/121, 141, 149

[56] References Cited

U.S. PATENT DOCUMENTS 3,501,380 3/1970 Perch ..... 202/262
3,959,082 5/1976 Thijssen ..... 201/1

FOREIGN PATENT DOCUMENTS 25630 3/1981 European Pat. Off. .
7804792 11/1978 Netherlands ..... 374/149
2073408 10/1981 United Kingdom ..... 201/1

*Primary Examiner*—Barry S. Richman
*Assistant Examiner*—Joye L. Woodard
*Attorney, Agent, or Firm*—Stevens, Davis, Miller & Mosher

[57] ABSTRACT

In a method of making coke in coke-ovens of a coke oven battery, the coke temperature is measured using at least one infra-red sensor after pushing of the coke from a coke-oven and before quenching of the coke. A value corresponding to the difference between measured value of the coke temperature and a predetermined reference value is determined for each of a plurality of coke loads pushed from a series of coke-ovens. The mean of said difference values is determined and the combustion gas supply to at least a plurality of coke-ovens of the battery is adjusted in dependence on said mean of the difference values. In this way, better control of the temperature of the coke at the end of the coking time can be achieved, with less deviation of the coke temperature from the reference value.

5 Claims, 5 Drawing Figures

METHOD OF MAKING COKE IN A COKE OVEN BATTERY

BACKGROUND OF THE INVENTION

1. Field of the Invention

This invention relates to a method of making coke in coking chambers of a coke-oven battery and is particularly concerned with the control of the combustion gas supply to the burners of the battery. The invention also provides a method of measuring the temperature of hot coke.

2. Description of the Prior Art

A coke-oven battery has a number of coking chambers. Between each pair of adjacent coking chambers, there is a combustion wall containing a plurality of combustion chambers. Combustion of gas takes place in the combustion chambers to provide the heat required for the coking process. A battery may have a great many, e.g. in the order of a thousand, combustion chambers. Below the coking chambers and the combustion chambers there are regenerators in which waste heat from the burned combustion gases is used to heat the incoming combustion air. Each regenerator is periodically switched over from heating air to being heated by hot gases.

In the preparation of coke, by a batch process, coking coal is dry-distilled in the coking chamber for a period of time called the coking time. During the coking time, the temperature of the charged load of coal, hereinafter called coke cake, rises more rapidly near the combustion walls than in the middle. The coke cake is pushed out of the coking chamber after the expiry of the coking time (this operation is called pushing) and transferred to a quenching car via a so-called coke guide. Then the hot coke is conveyed in the quenching car to a quenching installation and quenched with water.

The control of the heat supply in the coking process can be considered at three levels, going from the smaller scale to the larger;

the combustion chamber level the combustion wall level the battery level.

At the combustion chamber level what matters is that each combustion chamber should have the right temperature with respect to the other combustion chambers of the same combustion wall. This is a matter of a correct distribution of gas between the combustion chambers of a combustion wall. Correction of a combustion chamber is an incidental operation and is effected by the readjustment of louvre bricks and cleaning or repair of the refractory structure.

At the combustion wall level what matters is that each combustion wall should have the right temperature with respect to the other combustion walls of a battery. This is a matter of a correct distribution of gas between the combustion walls of a battery. Correction of a combustion wall is effected by adjustment of the gas supply, e.g. using a diaphragm valve, cleaning of supply lines, shut-off valves etc.

At the battery level it is a matter of supplying the correct amount of heat. Correction is effected by adjustment of the total quantity of gas.

The temperature of the coke cake rises during the coking time. During the operation of the battery, a pushing sequence is used, e.g. for five chambers the order 1-3-5-2-4. The coking chambers are thus filled and pushed in a certain sequence. As a result, the state at any moment of the coking processes in the different coking chambers is very varied. Finally the temperature of parts of the coking battery structure varies due to the periodic switching over of the regenerators. In controlling the coking process, use is made of temperature measurements carried out on the coke-oven battery structure. In interpreting the results of these temperature measurements, allowance must be made for the above-mentioned temperature cycles and this makes the control of the coking process at the three levels mentioned above more difficult.

For many years temperatures in the combustion chambers have been measured for the purpose of control of the coking process, using an optical pyrometer. The difficulty with this measuring method is the low accuracy of the result. The measurement is really only useful for control at the combustion chamber level when nothing better is available.

GB-A-1,393,046 describes a method of the control of the battery temperature, in which it is sought to maintain a time-averaged constant value of the battery temperature. In this method the temperature of the regenerator checkerwork is measured and held constant by adjusting the gas supply. This control at battery level is an open regulation of the coke temperature at the end of the coking time. FR-A-2,318,918 describes a method of combustion control of the same type, in which flue temperatures are measured.

From EP-A-0025630 it is known to measure the temperature of the coke in the quenching car using an infrared sensor. During the transfer of the coke from the coking chamber to the quenching car, the coke is distributed along the length of the quenching car from the coke side towards the machine side (these are the two sides of the battery). The coke cake collapses vertically, so that the temperature differences in the vertical and width direction of the coke cake are evened out. In the method disclosed in EP-A-25630 the measurement of coke temperature in the quenching car is used for the location and adjustment of combustion walls with a deviant mean temperature (control at the combustion wall level) and for location and adjustment of combustion chambers with a deviant temperature (control at the combustion chamber level). The infrared sensor measures the surface temperature of the coke in the quenching car. Its aperture angle and height above the quenching car are such that it views a substantial part of the width of the coke in the quenching car.

Expert opinion has been that it is desirable to aim to keep the temperature constant at the levels of the combustion chamber, combustion wall and battery. A difficulty in this strategy is that the temperature of the coke cakes at pushing varies considerably.

SUMMARY OF THE INVENTION

The object of the invention is to provide a method of making coke in a coke oven battery which achieves improved control of the coke temperature at the end of the coking time.

Another object of the invention is to provide an improved method for measuring the temperature of coke.

According to the invention there is provided a method comprising the following steps:

(a) measuring the coke temperature after pushing of the coke out of a coke-oven into the quenching car and before quenching using at least one infrared sensor, (b) determining a value corresponding to the difference between the temperature of the coke in the quenching car and a predetermined reference value for the temperature of the coke at the end of the coking time, (c) determining the mean of a series of said difference values relating to the coke loads obtained from a series of coke-ovens and (d) adjusting the combustion gas supply to the burners of at least a plurality of coking chambers of the coke-oven battery in dependence on said mean of the difference values.

The reference value for the temperature at the end of the coking time must be chosen with various factors in mind:

(i) with a higher reference value the emission of e.g. gas and smoke on pushing of the coke is lower;

(ii) the quality of the coke produced is dependent on the reference value;

(iii) with a lower reference value less energy (i.e. less gas) is used;

(iv) with a given maximum heat load on the coke-oven battery structure, coke production is higher with a lower reference value.

Another critical factor however is the temperature at which the coke cake has undergone sufficient shrinkage to prevent high forces on the combustion walls and the struts during the pushing operation. The reference value is chosen to be as low as possible and is preferably equal to the temperature at which the coke cake has undergone sufficient shrinkage, with an added margin to allow for the standard deviation of the actual coke temperature at pushing.

The method according to the invention, as a result of which the coke is prepared with a temperature at the end of the coking time falling within a narrow range has various advantages:

(i) undesirable emissions during pushing can be largely prevented, (ii) coke of a uniform quality can be obtained, (iii) the coke can be pushed at the end of the coking time with a lower temperature on average, so that less energy is used in the overall running of the battery, (iv) high forces on the combustion walls and the struts due to too low a coke temperature at pushing, and consequent wear and damage, can be prevented, so that a longer battery life can be achieved.

As has been remarked above, temperature differences over the height and width of the coke cake are evened out during the transfer of the coke into the quenching car. The temperature measured in the quenching car with the infrared sensor is hence after processing representative of the mean temperature of the coke at the end of the coking time. Allowance can be made during further processing of the measurement value for any temperature variations measured over the length of the quenching car which correspond to variations in the temperature of the coke cake from coke to machine side.

By adjusting the gas supply on the basis of a mean of difference values, the effect on the gas supply to a number of coke ovens of a coke-oven with a strongly deviant coke temperature at the end of the coking time is smoothed out. On the other hand systematic deviations of the coke temperature at pushing for the series of coke ovens is corrected by adjusting the gas supply at effectively the battery level.

The temperature of the coke in the quenching car can be measured with one or more infrared sensors.

It appears that the surface of the coke in the quenching car has cooled off to some extent at the time of measurement with infrared sensors. Preferably therefore the temperature of the coke load or pile in the quenching car is measured under the surface of the coke pile as seen in the gaps between the coke lumps using an infrared sensor having a narrow measuring aperture angle. Preferably this aperture angle (or sensing angle) is such that the measuring spot of the infrared sensor at the location of the surface of the coke in the quenching car is less than 100 mm in width, more preferably less than 40 mm in width. The temperature of the coke in the quenching car is thus measured below the cooled surface, and the measured temperature is largely independent of the extent of cooling of the coke surface. This cooling varies as a function of the distance between the coke oven from which the coke came and the measuring point.

For the purpose of eliminating temperature variations of the coke in the quenching car resulting from the deviation of the actual coking time from the planned coking time, the measured temperature of the coke in the quenching car is preferably corrected after measurement for deivation of the actual coking time relative to the planned coking time. Use is here made of a relationship between the temperature of the coke at the end of the coking time and the length of the coking time. A determination is made before the difference from the target value is determined of what the temperature of the coke was, or would have been, at the end of the planned coking time for a coking time which is longer, or shorter, than planned. This makes the method of the invention more effective.

It is preferred that the adjustment of the gas supply takes place according to the invention for the burners belonging to a considerable number of coke ovens. Gas supply and combustion gas removal arrangements common to all the coke ovens of a battery are often present. In that case, it is preferred to adjust the supply of gas to the burners belonging to all the coke-ovens of the battery simultaneously.

The series of coke-ovens for which measurements of coke temperature are made can be chosen in various ways. Thus for instance a mean of difference values can be determined for those coke-ovens of a battery which are discharged during a shift, and the gas supply adjusted on the basis of this difference. The series can however be chosen in relation to the pushing sequence. In the latter case, it is practical to determine the mean of differences per series of pushed coke-ovens and adjust the gas supply after the discharge of the series. The series can be fewer than the total number of coke-ovens in the battery.

In a practical embodiment of the invention the method is applied in a master-slave system, in which the gas supply to the burners is in addition adjusted using a conventional feedback control method, e.g. on the basis of a temperature measured in the coke-oven battery structure, e.g. the regenerator temperature. In this case the conventional feedback control method is adjusted on the basis of the means of difference values in accordance with the invention.

In another aspect, the invention provides a method for measuring the temperature of a hot coke pile of coke lumps using at least one infrared sensor, in which the temperature of the hot coke is measured under the surface of the coke pile as seen in the gaps between the coke lumps using an infrared sensor having a narrow measuring aperture angle. Suitably this aperture angle is such that the measuring spot at the location of the surface of the coke is less than 100 mm in width and more preferably less than 40 mm in width. This method of measurement is applicable to any pile or body of hot coke lumps. The term pile is used generally, to include a body of coke in a vessel, e.g. a quenching car.

BRIEF DESCRIPTION OF THE DRAWINGS

A preferred embodiment of the invention, and a non-limitative example thereof, will now be described with reference to the accompanying drawings, in which.

DESCRIPTION OF THE PREFERRED EMBODIMENT

Figure 1:
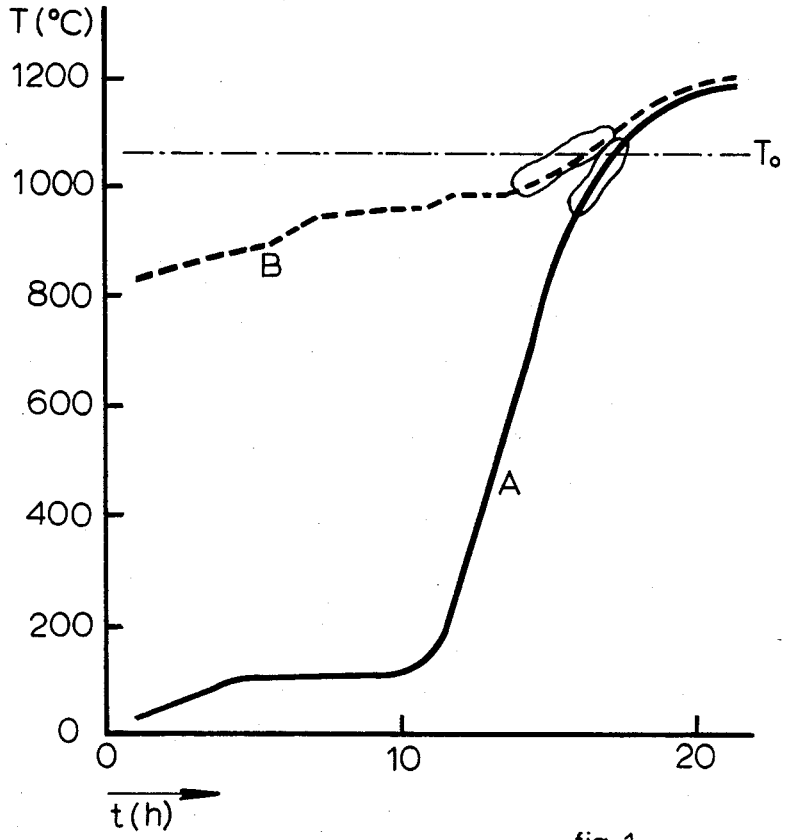
FIG. 1 is a graph representing the progress of the temperature of coke in a coke-oven during the coking time.

In FIG. 1 the progress of the temperature T of coke during the coking time t is given for the middle of the coke cake (line A) and the coke cake immediately adjacent to the combustion walls (line B). $T_o$ is a reference value for the coke temperature at the end of the coking time. It can be seen from the graph that the line B at the end of the coking time has a smaller slope than line A. The measurement of the temperature of the edge of the coke cake is not so good, as a measure of the temperature at the end of the coking time, as the temperature of the coke in the quenching car.

Figure 2:
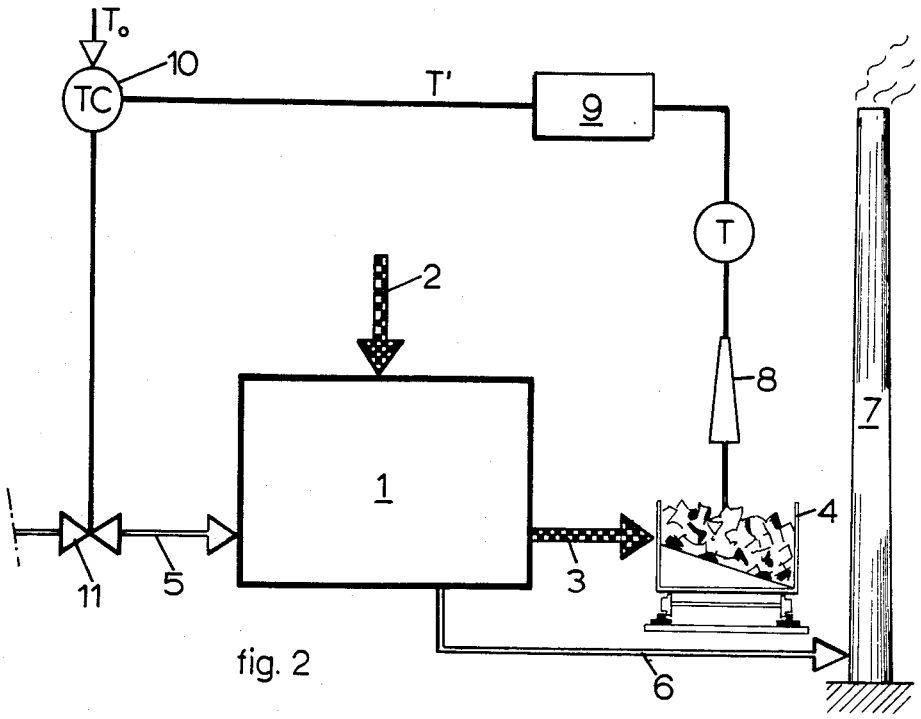
FIG. 2 is a diagram illustrating the adjustment of the gas supply according to the invention.

In the diagram of FIG. 2, there is diagrammatically shown a coke-oven battery 1, the coke-ovens of which are filled in the direction indicated by the arrow 2 with coking coal. At the end of the coking time the coke is pushed in the direction of the arrow 3 and transferred to the quenching car 4. The energy required for the coking process is obtained by the combustion of gas supplied to the coke-oven battery in the direction of arrow 5. The combustion gases are brought to the stack 7 along the direction indicated by arrow 6.

The temperature T of the coke from each coke-oven is measured after pushing into the quenching car 4 using an infrared sensor 8. A correction 9 is applied to the temperature of the coke thus measured at the end of the actual coking time, leading to the determination of a corrected temperature T′ appropriate to the planned coking time. The supply of gas 5 via valve 11 is adjusted using the control device 10 on the basis of a mean value of the differences between the corrected temperature T′ of the coke in the quenching car and the reference value $T_o$ for a series of coke loads pushed from a series of coke-ovens.

In practice, the method most appropriate for the adjustment of the gas supply is a variation of the so-called pause period during switching over of the regenerators.

Because of the high thermal capacity of the coke-oven battery structure, it is not practical to adjust the gas supply on the basis of the coke temperature measured in the quenching car after each pushing operation of a coke-oven. A good practice is to adjust the gas supply after the pushing of the coke-ovens which belong to the same series in the pushing sequence in operation or at the end of a shift, and on the basis of the mean value of the differences of the coking temperature measured in the quenching car and the reference value $T_o$ of all coke ovens of the series or of all the coking chambers which have been pushed during the shift.

The coke temperature measured in the quenching car appears to be a good starting point for adjusting the gas supply to the battery in the event of machine failure and when changing the planned coking time of a battery.

The coke temperature in respect of each coke-oven as measured in the quenching car is also a good means of locating variations in the coking chambers. On this basis the control of the coking process can take place at the level of the combustion wall by correction of the supply of gas by adjustment of the gas supply using a diaphragm valve and by cleaning the gas supply line.

Figure 3:
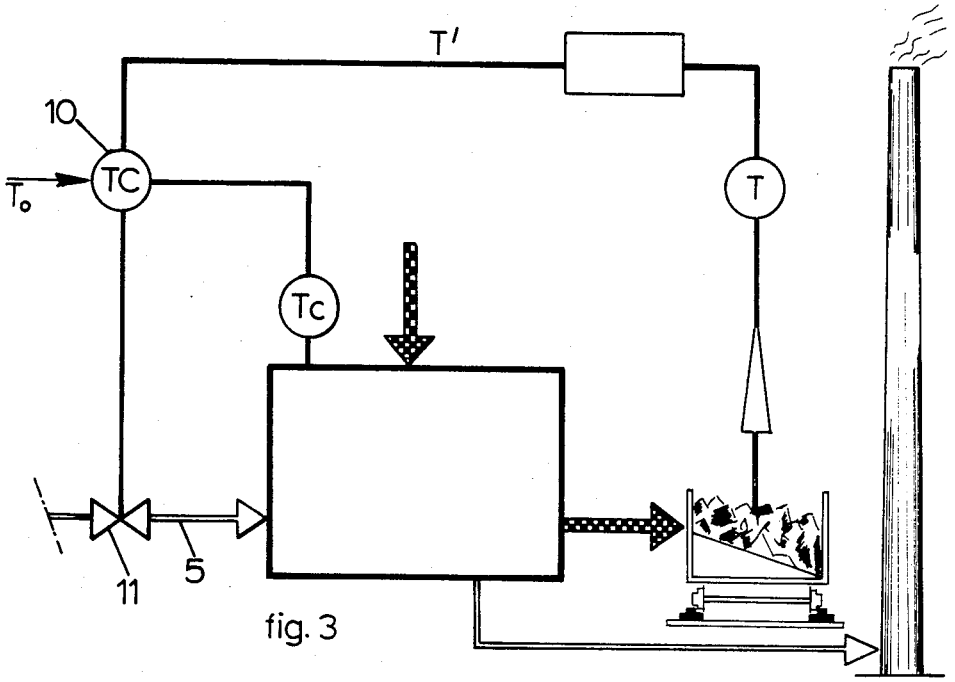
FIG. 3 is a diagram illustrating the adjustment of the gas supply according to a specific embodiment of the method.

FIG. 3 shows a specific embodiment of the method in which the gas supply 5 is adjusted using the control device 10 and valve 11, on the basis of for instance a temperature $T_c$ measured in the coke-oven battery structure, e.g. the so-called regenerator temperature, where this control is adjusted on the basis of the mean value of the differences between the corrected temperature T′ of coke in the quenching car and the reference value $T_o$.

EXAMPLE

This example refers to a coking plant with 108 identical coke-ovens (coking chambers) with a height of six and a half meters. The coking plant is divided into four identical coke-oven batteries 21,22,23 and 24 each with twenty seven coke-ovens. The method according to the invention was introduced for these batteries. The temperature at which the coke cake has adequate shrinkage is 1020° C. for the mixture of coal employed. The reference temperature $T_o$ for the temperature of the coke at the end of the coking time was established at 1050° C. The planned coking time was eighteen hours. The temperature of the coke in the quenching car was measured with an infrared sensor with a measurement spot of 20 mm at the location of the upper surface of the pile of coke in the quenching car.

The temperatures of the coke measured in the quenching car before adjustment of the supply of gas on the basis of the difference from the reference value, i.e. before application of the method of the invention, can be summarised as follows:

TABLE I

| Battery | Temperature of coke in quenching car | |
|---|---|---|
| | Mean value (°C.) | Standard deviation (°C.) |
| 21 | 1023 | 43 |
| 22 | 1054 | 27 |
| 23 | 995 | 39 |
| 24 | 1020 | 40 |

Figure 4:
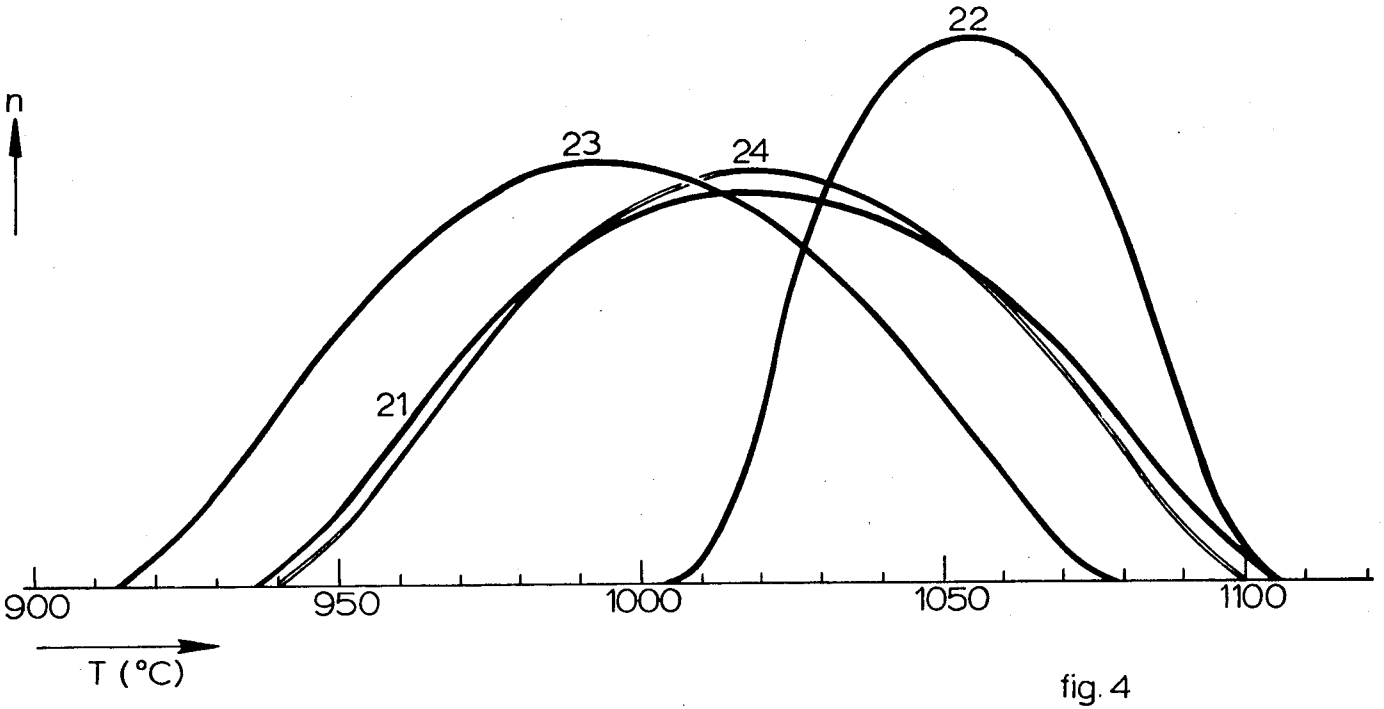
FIGS. 4 and 5 show frequency distributions for the temperature of the coke in the quenching car.

FIG. 4 shows a frequency distribution related to the results of Table I with, along the horizontal axis, the temperature t in °C. of the coke as measured in the quenching car and, along the vertical axis, the number of coke ovens n. It can be seen that (i) the mean value of the coke temperature of the batteries deviates by almost 60° C.

(ii) the standard deviation is about 40° C.

After the introduction of the method of the invention the following results were achieved.

TABLE II

| | Battery Temperature of coke in quenching car | |
|---|---|---|
| | Mean value (°C.) | Standard deviation (°C.) |
| 21 | 1051 | 29 |
| 22 | 1040 | 26 |
| 23 | 1041 | 25 |
| 24 | 1049 | 22 |

Figure 5:
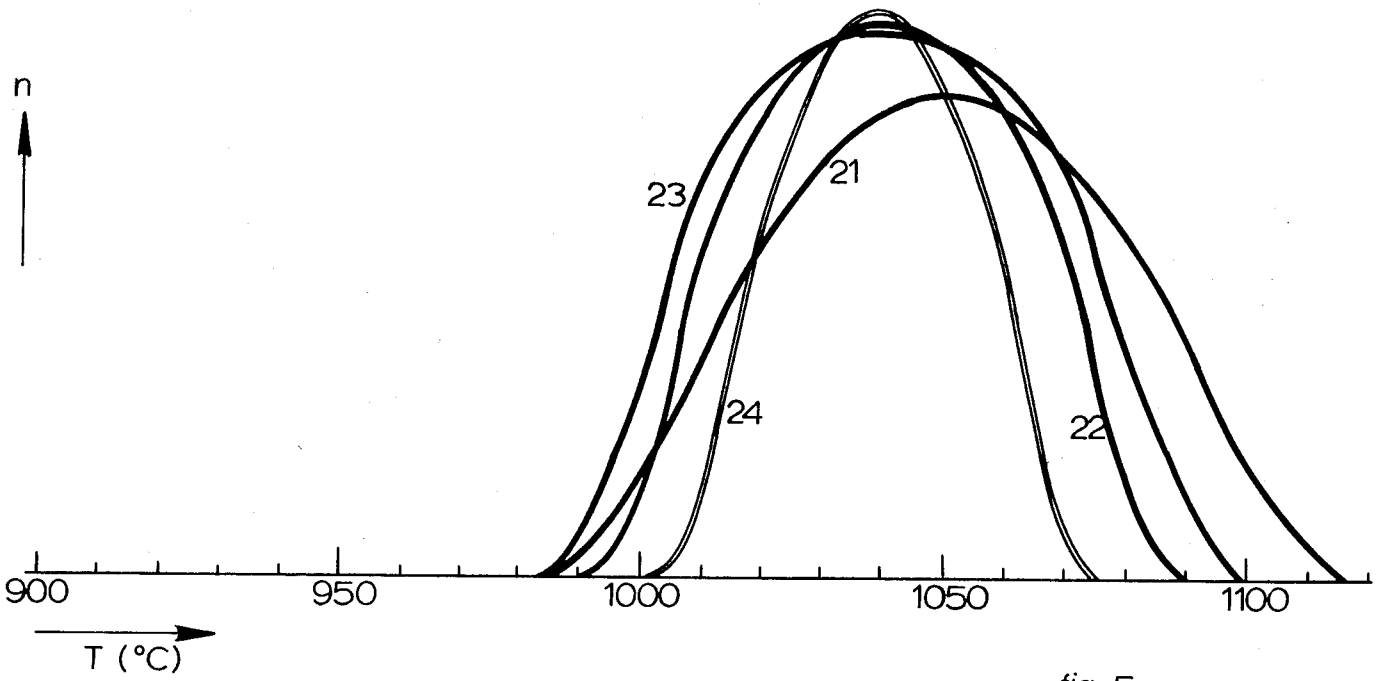

The related frequency distribution is reproduced in FIG. 5, which should be compared with FIG. 4. It can be seen that (i) the mean value of the final coke temperatures of the batteries is very close to 1050° C.

(ii) the standard deviation is reduced to about 25° C.

Thus in this Example a substantial improvement is achieved.

What is claimed is:

1. In a method of making coke in coke-ovens of a coke oven battery wherein a combustion fuel gas is supplied to heat each of said coke-ovens, the improvement comprising the steps of:

(a) measuring the coke temperature of each of a plurality of coke loads pushed from a series of said coke-ovens of the battery while the coke is in a quenching car and before quenching of the coke utilizing at least one infrared sensor, (b) determining for each of said plurality of coke loads, a difference temperature value corresponding to the difference between the said measured pushed coke temperature and a predetermined pushed coke temperature reference value, (c) determining the mean of said difference temperature values, and (d) adjusting the total quantity of combustion fuel gas supplied to said series of coke-ovens of the battery in dependence on said mean of the difference temperature values to minimize temperature deviations between said each load of a plurality of coke loads pushed from said series of coke-ovens.

2. A method according to claim 1 wherein the coke temperature measured in step (a) is the temperature under the upper surface of the coke as seen in the gaps between coke lumps, using an infra-red sensor having a limited measuring aperture angle.

3. A method according to claim 2 wherein the aperture angle of the infra-red sensor produces a measurement spot at the surface of the coke of less than 100 mm in width.

4. A method according to claim 3 wherein said measurement spot is less than 40 mm in width.

5. A method according to claim 1 including determining a corrected measured temperature for each load of said plurality of coke loads pushed prior to determining said difference temperature value for correcting any variation in actual coking time relative to a predetermined coking time.

* * * * *